United States Patent [19]

Childers et al.

[11] Patent Number: 4,767,556

[45] Date of Patent: Aug. 30, 1988

[54] LOW-SLING FIBER LUBRICANT COMPRISING SHEAR-REDUCED, HIGH MOLECULAR WEIGHT POLYISOBUTYLENE

[75] Inventors: John T. Childers, Monroe; Issac D. Fleming, Charlotte, both of N.C.

[73] Assignee: Henkel Corporation, Ambler, Pa.

[21] Appl. No.: 900,016

[22] Filed: Aug. 25, 1986

[51] Int. Cl.[4] ..... D06M 15/227

[52] U.S. Cl. ..... 252/8.6; 8/115.6; 428/394; 428/395; 428/378

[58] Field of Search ..... 585/11, 13; 428/394, 428/395, 378; 252/8.6; 8/115.6

[56] References Cited

U.S. PATENT DOCUMENTS

| | | | |
|---|---|---|---|
| 2,421,082 | 5/1947 | Heidelberg | 585/13 |
| 2,876,199 | 3/1959 | Wasson | 585/11 |
| 3,208,946 | 9/1965 | Anderson | 585/11 |
| 3,215,154 | 11/1965 | White | 585/11 |
| 3,805,918 | 4/1974 | Altgelt | 585/13 |
| 3,855,135 | 12/1974 | Newingham | 585/11 |
| 3,977,979 | 8/1976 | Crossfield et al. | 252/8.6 |
| 4,098,702 | 7/1978 | Crossfield et al. | 252/8.6 |
| 4,098,703 | 7/1978 | Crossfield et al. | 252/8.6 |
| 4,105,569 | 8/1978 | Crossfield | 252/8.6 |
| 4,110,227 | 8/1978 | Newkirk | 428/395 |
| 4,199,647 | 4/1980 | Newkirk | 428/394 |
| 4,245,004 | 1/1981 | Login | 428/394 |
| 4,400,281 | 8/1983 | Dehm | 252/8.6 |

OTHER PUBLICATIONS

Boehme Filatex–Technical Bulletin (undated).
Hoechst–Technical Bulletin (Aug. 1975).

*Primary Examiner*—William R. Dixon, Jr.
*Assistant Examiner*—Jerry D. Johnson
*Attorney, Agent, or Firm*—Ernest G. Szoke; Henry E. Millson, Jr.

[57] ABSTRACT

Ultrahigh molecular weight (average mw at least about 5,000,000) polyisobutylene additives are compounded with mineral oil vehicles under very low shear conditions to provide consistently low-sling fiber lubricants for a range of textile operations; the lubricants are particularly suited for very high speed operations.

24 Claims, No Drawings

LOW-SLING FIBER LUBRICANT COMPRISING SHEAR-REDUCED, HIGH MOLECULAR WEIGHT POLYISOBUTYLENE

BACKGROUND OF THE INVENTION

1. Field of the Invention

Low-sling additives for fiber lubricants, especially coning oil type lubricants, are well-known in the art as protective coatings for fibers in a variety of textile operations. Many of these additives, particularly relatively low molecular weight polymers such as polyisobutylene, are in common use to improve adherence of the lubricant to the fiber and reduce lubricant "sling-off" during yarn winding operations.

2. Discussion of Related Art

While these additives have proved generally useful in lubricants for low-to-medium speed fiber winding operations (for example, for yarn speeds up to about 500 meters/minute), in ultra high speed winding operations conventional low molecular weight polyisobutylene and comparable low-sling polymer additives have not sufficed to reduce lubricant slign-off to acceptable levels. Further, these known additives are not uniformly reliable and tend to perform erratically under varying process parameters, particularly with respect to fiber type, yarn speed, machinery characteristics, processing temperatures, and recirculation conditions. For general commercial acceptability, it is important that fiber lubricants for man-made fibers reduce friction between the yarn and contact surfaces, for example surfaces of processing machinery or interfaces with other fibers; adhere to the yarn to reduce sling-off during processing; and be scourable to permit substantially complete removal before downstream operations such as dyeing and finishing, with which lubricant residue would substantially interfere. It is particularly important that lubricant compositions consistently function well to perform these tasks under a variety of operating conditions, in order to obviate the necessity of reevaluating and reformulating each lubricant composition on an ad hoc basis.

The invention accordingly provides a high-tack fiber lubricant which has broad applicability and which exhibits low-sling characteristics over a broad range of fiber types, lubricant add-on requirements, and yarn processing conditions. Lubricants according to the invention are especially useful in ultra high speed winding operations, particularly those involving yarn speeds in excess of about 700 meters/minute, wherein lubricant sling-off is minimized while adequate fiber lubrication and scourability are maintained.

The lubricant composition of the invention comprises ultra high molecular weight oil-soluble polyisobutylene in a mineral oil vehicle with sufficient emulsifier to ensure a storage stable, uniform composition, which is readily scoured from the fiber. The composition further optionally includes customary lubricant additives such as antistatic agents to reduce static charge build-up fibers during processing, and corrosion inhibitors to protect vulnerable machine component parts. Compounding and handling conditions must be strictly observed to maintain consistent product performance. In particular, it has been found to be critical to avoid shear of sufficient force to disrupt polymer integrity during product handling, especially during formulation of the composition. Mixing and circulation/recirculation operations involving strong agitation, mechanical pumping, or operations inducing similar product stress, such as filtration, are thus to be avoided.

DETAILED DESCRIPTION OF THE INVENTION

Isobutylene polymers suitable for use as low-sling additives in the high-tack lubricants of the invention comprise polyisobutylenes having an number average molecular weight from about 4,500,000 to about 5,500,000; polymer compositions having a mixture of isobutylene polymers ranging from an average molecular weight above about 2,000,000 up to about 6,000,000 which provide the specified polymer average molecular weight are broadly useful. For use in the compositions of the invention, the polymers are generally employed in oil solution; typically the polymer additive is incorporated into the lubricant as a solution comprising about 90 to about 95% mineral oil, with the balance polyisobutylene. Conveniently, the rubbery isobutylene polymer is predissolved in a portion of the oil vehicle to form an additive solution by processes known in the art for dissolving solid polymers of this type in oil, as by heating for the required period of time. Alternatively, a commercially available product comprising a solution of high molecular weight polyisobutylene in oil is employed. The polyisobutylene "additive solutions" referred to herein are additive solutions comprising about 5% high molecular weight polyisobutylene and about 95% oil by weight; equivalent fiber lubricants according to the invention are prepared by using additive solutions containing more or less polyisobutylene by proportion, and adjusting the amount of additive solution employed in the lubricant to give an equivalent concentration of polyisobutylene.

The polymer additive is incorporated into the oil vehicle, conveniently mineral oil characterized by a viscosity of from about 40 to 200 SUS at 100° F. (all viscosity measurements recited herein are in SUS at 100° F.), in an amount sufficient to obtain the requisite level of lubricant tackiness for the particular application, with particular reference to fiber type, yarn speeds, yarn travel conditions (e.g., yarn jerking on slack take-up), incidence of yarn contact points (e.g., yarn bumping), and the range of lubricant add-on employed to achieve fiber protection. Generally, as previously noted, additive content of the lubricant is adjustible within a narrow range according to the invention to achieve optimally reduced oil sling under a variety of fiber processing parameters, thereby obviating the extensive experimentation heretofore necessary to achieve good results under prior art guidelines.

Under the ultra high speed winding operations contemplated according to the invention, additive solution concentrations from above about 1 to up to about 3% by weight of the lubricant product, typically from above about 2% by weight, will function to reduce lubricant sling to very acceptable levels over a broad range of conditions. Thus, for an average high-speed textile operation involving polyester yarn travelling at yarn speeds in excess of about 800 meters/minute with a lubricant add-on range of from about 2% to 6% lubricant, concentrations of this additive solution (5 wt. % polyisobutylene having an average mw of about 5,000,000 in mineral oil solution) of from about 1% up to about 3% by weight of lubricant products (i.e., from about 0.05% to about 0.15 wt. % polymer) provide optimum sling reduction.

The polyisobutylene additive is incorporated into the mineral oil vehicle in conjunction with one or more emulsifiers in sufficient quantities to stabilize and homogenize the formulation and afford scourability of the lubricant from the substrate material. The emulsifiers are added in amounts typically ranging from about 5% to about 20% by weight of the total product and more typically from about 10 to about 18% by weight. In high speed applications of the type described supra, employing about 1% to about 3% by weight of additive solution (based on weight of product), an amount of emulsifier of about 15% by weight, ± about 5% based on the combined weight of vehicle and additive, will generally be effective, depending on the particular emulsifiers employed and operation parameters. Useful emulsifiers include those well-known in the art for use with fiber lubricants, especially alkoxylated (usually ethoxylated) $C_8$–$C_{18}$-fatty acids, $C_8$–$C_{18}$-alcohols, and $C_8$–$CH_{18}$-alkyl phenols.

The low-sling lubricant of the invention advantageously (and preferably, in many applications) includes a minor amount of additional optional ingredients, particularly antistatic agents, corrosion inhibitors, perfumes, and wetting agents, all of which are selected from conventional fiber lubricant additives known to perform such functions; additives which promote lubricant distribution on the fiber substrate are particularly useful. A small percentage (usually below about 1%) water may be present in the formulation.

Typical lubricant products according to the invention are those having the following concentrations (percentages are expressed in percent by weight based on total weight of composition):

| INGREDIENTS | RANGE OF CONCENTRATION (wt %) |
|---|---|
| Mineral Oil (80–100 SUS) | 78–90 |
| Polyisobutylene (avg. mw $5 \times 10^6$, 94% oil base) | 1.0–3.0 |
| Emulsifiers | 5.0–20 |
| Water | 0–1.0 |
| Optional ingredients (perfume, wetting agent, corrosion inhibitor, antistatic agent, or comparable ingredient) | 0–7.0 |

Preferably at least about 80% of the lubricant by weight comprises the mineral oil vehicle.

Lubricant viscosity is chosen to optimize lubricant characteristics in the particular application contemplated; excessively low lubricant tackiness, which exacerbates misting and oil sling tendencies, and excessively high lubricant tackiness, which tends to increase friction and fiber drag, are to be avoided. After the appropriate lubricant viscosity for the application is determined (usually over a range of about 10 SUS) the oil vehicle is selected accordingly. In usual practice, a vehicle comprising a single oil or a blend of oils having a vehicle viscosity of from about 5 to 50 SUS lower than the desired product viscosity is initially selected; incorporation of the polyisobutylene additive then substantially increases the viscosity of this admixture above the desired product viscosity, with the degree of increase dependent upon the amount of additive and polymer number average molecular weight. Admixture viscosities of from about 10 to 30 SUS above final product viscosities are typical. Viscosity of the admixture is then reduced by the controlled application of gentle shear forces to the shear-sensitive admixture until the desired final product viscosity is obtained. This controlled-shear method suprisingly provides a product having oil sling characteristics superior to products obtained by customary processes wherein an oil vehicle and polymer additive are merely randomly combined to provide a predetermined product viscosity. Tackiness of the product and accompanying oil sling characteristics are thus primarily a function of vehicle viscosity, polymer number average molecular weight and concentration, and amount of shear applied to the shear-sensitive lubricant ingredients. It is generally advisable to start with a polymer concentration at the low end of the specified range, and increase polymer content as necessary to improve tack and compensate for adverse processing conditions; vehicle viscosity and application of shear forces can then also be adjusted, if necessary, to improve tack. A useful laborabory tack test, albeit subjective, is to observe lubricant droplets sliding off the end of a glass stirring rod, and to increase or decrease tackiness of the lubricant, as conditions dictate, by increasing or decreasing concentration of ultrahigh molecular weight polyisobutylene. Generally, a final product viscosity of from about 50 to about 200 SUS at 100° F., preferably about 90 to 115 SUS, will prove satisfactory in combination with the disclosed parameters of polymer type and amount and vehicle viscosity for a broad range of applications.

The lubricants according to the invention are strictly compounded under low shear conditions to substantially maintain polymer integrity and thereby preserve product characteristics. Mechanical pumping of the product, including pumping in process recirculation systems, is to be avoided after addition of polyisobutylene. In an exemplary procedure, the emulsifier is added to the mineral oil under normal agitation, followed by addition of optional ingredients and water while continuing agitation. After mixing is complete (several minutes are usually required, depending upon bulk quantity rate of agitation, and mixing equipment), agitation is stopped pending charging of the polyisobutylene additive (pre-dissolved in oil vehicle). Agitation is then restarted and the ingredients mixed under mild agitation for another several minutes until properly combined and the desired viscosity achieved. The viscosity of the batch is periodically checked to ensure conformance to specification. As previously noted, a final viscosity of from about 90 SUS to about 115 SUS, usually about 100 SUS ±10, is generally acceptable for most applications. The product is shipped, critically without application of substantial shear forces, such as by filtration or mechanical pumping, after additive compounding. Exemplary mixing times (based on 5500 gallon quantities, standard equipment, mild agitation) are about 10 minutes for the initial agitation (before polyisobutylene addition), and about 30 minutes (after polyisobutylene addition).

The low-sling lubricant product is particularly suitable for use on man-made fibers, especially nylon and polyester, in textile operations involving yarn speeds in excess of about 700 meters/minute, and particularly in excess of about 800 meters/minute. Textured yarns are particularly contemplated. The lubricant is formulated to a tackiness which optimizes lubricant characteristics in a particular application, and is applied to the fiber or other substrate by usual means (for example, by air pump) while avoiding shear forces on the lubricant. The product permits a broad range of applications of lubricant in textile operations without tedious extensive trial-and-error adjustments for each process, and permits maximization of equipment use by allowing high yarn velocities without concomitant oil splash and workplace hazards.

The invention is exemplified as follows:

EXAMPLE I

A. Composition

| INGREDIENTS | CONCENTRATION (wt % based on total weight) |
|---|---|
| Mineral Oil (60 SUS) | 59.11 |
| Mineral Oil (420 SUS) | 25.00 |
| Emulsifier (Ethoxylated $C_8$–$C_{18}$ alcohol) | 6.50 |
| Emulsifier (Nonylphenol ethoxylate) | 4.00 |
| Emulsifier (Ethoxylated $C_8$–$C_{18}$ fatty acid) | 2.50 |
| Wetting Agent | 0.10 |
| Perfume | 0.04 |
| Water | 0.05 |
| Polyisobutylene low-sling additive: 5 wt % polyisobutylene (avg. mw $5 \times 10^6$) in mineral oil solution | 2.25 |
| Total | 100.00 |
| Final Viscosity | 112 SUS |

A mixer was cleaned and dried, and charged with the mineral oil vehicle. After agitation was begun, each of the remaining ingredients was charged in the sequence listed, except for the water and polyisobutylene additive. The mix was then heated to 100° to 105° F. and then carefully weighed water was then added. This initial mix was continued for 15 minutes, and then agitation stopped. The polyisobutylene additive was then charged, and mild agitation restarted and continued for 30 minutes at 100° to 105° F. The product was removed to shipping containers.

B. The product lubricant from Example IA was applied to a textured polyester yarn which was processed on equipment wherein yarn speeds of up to about 900 m/minute were employed. Typical lubricant add-on levels for the yarn were 4.0±0.5%. The results were very good to excellent, with only slight oil sling being observed.

EXAMPLE II

A. The composition of Example I was compounded as described in Example IA, with the exception that 1.0% of the polyisobutylene additive was used instead of 2.25%, and that the final product had a viscosity of 95 SUS instead of 112 SUS.

B. The product of Example IIA was trialed as described in Example IB. The results were acceptable, with moderate oil sling observed

EXAMPLE III

A. The composition of Example I was prepared as described in Example IA, with the exception that 2.50% of the polyisobutylene was incorporated instead of 2.25%.

The higher tack product of the present example was trialed as described in Example IB, with very slight oil sling being observed

We claim:

1. A low-sling, high tack fiber lubricant having a final viscosity of from about 50 SUS to about 200 SUS and consisting essentially of:

(a) a mineral oil vehicle having a viscosity of from about 40 to 200 SUS in an amount of from about 78 to 90% by weight based on the weight of the lubricant;

(b) an ultra-high molecular weight polyisobutylene additive comprising a mixture of isobutylene polymers ranging in number average mw from about 2,000,000 to 6,000,000, said additive having a number average molecular weight of at least about 4,500,000, in an amount of from about 0.05% to about 0.15% by weight based on the weight of the lubricant; and (c) an emulsifier or mixture of emulsifiers in an amount sufficient to stabilize and homogenize the lubricant and to render the lubricant scourable;

wherein said lubricant is prepared by a process consisting essentially of steps (a), (b), and (c);

(a) selecting a mineral oil vehicle having a viscosity from about 5 to 50 SUS lower than the final viscosity of the lubricant, (b) admixing the selected vehicle, the emulsifier, and the ultra-high molecular weight polyisobutylene additive, to provide an admixture having a viscosity of from about 10 to 30 SUS above the final viscosity of the lubricant, and (c) applying controlled low shear forces to the admixture containing the polyisobutylene additive to reduce viscosity of the admixture to the final viscosity of the lubricant while substantially maintaining polymer integrity; and wherein all viscosity measurements are in SUS at 100° F.

2. The lubricant of claim 1 wherein the emulsifier or emulsifiers is present in an amount of from about 5 to about 20% by weight based on the weight of the lubricant.

3. The lubricant of claim 1 wherein the ingredient of paragraph (c) is a mixture of emulsifiers present in a total amount of from about 10% to about 18% by weight based upon the weight of the lubricant.

4. The lubricant of claim 3 wherein the mineral oil vehicle comprises at least 80% by weight of the composition.

5. The lubricant of claim 1, wherein the additive of paragraph (b) is present in an amount of about 0.10% by weight.

6. The lubricant of claim 1 wherein the additive of paragraph (b) is present in an amount of about 0.12% by weight.

7. The lubricant of claim 5 wherein the mineral oil vehicle of paragraph (a) comprises a blend of two mineral oils, each having a viscosity of from about 60 to 420 SUS.

8. The lubricant of claim 7 further including at least one ingredient selected from the group consisting of a wetting agent and a corrosion inhibitor, and an antistatic agent.

9. The lubricant of claim 4, wherein the polyisobutylene of paragraph (b) has a number average molecular weight of from about 4,500,000 to 5,500,000.

10. In a textile operation method of the type wherein a yarn attains a speed of at least about 700 meters/minute during processing, the improvement comprising applying a fiber lubricant according to claim 1 to the yarn before it is moved at said speed to substantially reduce lubricant sling from the yarn.

11. The method of claim 10 wherein the yarn attains a speed of at least about 800 meters/minute during processing.

12. The method of claim 11 wherein the yarn comprises one or more synthetic fibers.

13. The method of claim 12 wherein at least one of the fibers is polyester or nylon.

14. The method of claim 12 wherein at least one of the fibers is polyester.

15. The method of claim 14 wherein the polyester fiber is textured polyester.

16. The lubricant of claim 1, wherein the polyisobutylene additive of paragraph (b) is added as a solution of polyisobutylene in an oil base.

17. The lubricant of claim 16, wherein the solution comprises about 5% by weight polyisobutylene and about 95% by weight oil base.

18. A yarn carrying the lubricant of claim 1.

19. A yarn carrying the lubricant of claim 9.

20. A method for preparing a low-sling, high-tack fiber lubricant having a final viscosity of from about 50 to 200 SUS for use as a protective coating for fibers in textile operations consisting essentially of the following steps (a) and (b):

(a) admixing (i) a mineral oil vehicle having a viscosity from about 40 to 200 SUS and from about 50 to 50 SUS lower than the final viscosity of the lubricant, (ii) an emulsifier or mixture of emulsifiers in an amount sufficient to stabilize and homogenize the lubricant and render it scourable, and (iii) an ultra-high molecular weight polyisobutylene additive having a number average molecular weight of at least about 4,500,000 and comprising a mixture of isobutylene polymers ranging in number average molecular weight from about 2,000,000 to 6,000,000, to provide an admixture having a viscosity of from about 10 to 30 SUS above the final viscosity of the lubricant; and (b) applying controlled low shear forces to the admixture containing the polyisobutylene additive to reduce the viscosity thereof to the final viscosity of the lubricant and provide a lubricant containing from about 78% to 90% by weight mineral oil vehicle, from about 0.05% to 0.15% by weight polyisobutylene additive, and having a final viscosity of from about 50 to 200 SUS;

wherein the percentages are based on the weight of the lubricants and the viscosities are in SUS at 100° F.

21. The method of claim 20, wherein the mineral oil vehicle and emulsifier are first admixed under normal shear conditions, and the polyisobutylene additive is admixed with the mineral oil vehicle and emulsifier admixture under said controlled low-shear conditions.

22. The method of claim 20, wherein the final lubricant viscosity is from 90 to 115 SUS.

23. The lubricant of claim 1, wherein the mineral oil vehicle and emulsifier are first admixed under normal shear conditions, and the polyisobutylene additive is admixed with the mineral oil vehicle and emulsifier admixture under said controlled low-shear conditions.

24. The lubricant of claim 1, wherein the final lubricant viscosity is from 90 to 115 SUS.

* * * * *